US010342274B2

(12) United States Patent
Lim

(10) Patent No.: US 10,342,274 B2
(45) Date of Patent: Jul. 9, 2019

(54) PROTECTIVE GLOVE INCLUDING IMPACT PROTECTION

(71) Applicant: Ringers Technologies LLC, Houston, TX (US)

(72) Inventor: Hardy Lim, Houston, TX (US)

(73) Assignee: Ringers Technologies LLC, Houston, TX (US)

( * ) Notice: Subject to any disclaimer, the term of this patent is extended or adjusted under 35 U.S.C. 154(b) by 174 days.

(21) Appl. No.: 15/341,586

(22) Filed: Nov. 2, 2016

(65) Prior Publication Data

US 2018/0049490 A1 Feb. 22, 2018

Related U.S. Application Data

(63) Continuation of application No. 29/568,716, filed on Jun. 21, 2016, now Pat. No. Des. 824,111.

(51) Int. Cl.
*A41D 19/015* (2006.01)

(52) U.S. Cl.
CPC . *A41D 19/01523* (2013.01); *A41D 19/01505* (2013.01); *A41D 19/01547* (2013.01)

(58) Field of Classification Search
CPC ..... A41D 13/08; A41D 13/0153; A41D 13/0568; A41D 13/065; A63B 71/1225
USPC ..... 2/16, 20, 161.1, 159, 168
See application file for complete search history.

(56) References Cited

U.S. PATENT DOCUMENTS

| | | | |
|---|---|---|---|
| 2,686,316 | A | 8/1954 | Linn |
| 4,000,524 | A | 1/1977 | Rinehart |
| 4,272,849 | A | 6/1981 | Thurston et al. |
| 4,454,611 | A | 6/1984 | Tschirch et al. |
| 4,570,269 | A | 2/1986 | Berlese |
| 4,766,612 | A | 8/1988 | Patton, Sr. |
| 4,815,147 | A | 3/1989 | Gazzano et al. |
| 5,016,286 | A | 5/1991 | Henriksen |
| D328,369 | S | 7/1992 | Hong |
| 5,349,705 | A | 9/1994 | Ragan |
| 5,488,739 | A | 2/1996 | Cardinal |

(Continued)

FOREIGN PATENT DOCUMENTS

| | | |
|---|---|---|
| CN | 2909876 | 6/2007 |
| CN | 201821981 | 5/2011 |

(Continued)

*Primary Examiner* — Gloria M Hale

(74) *Attorney, Agent, or Firm* — Jason P. Mueller; Adams and Reese, LLP

(57) ABSTRACT

A protective glove includes one or more fabrics coupled together into a form of a hand, with the form having a palm side and a dorsal side opposite the palm side, and protective structures disposed on the dorsal side. The protective structures include a first protective structure on the dorsal side arranged to protect at least a portion of an index finger metacarpal bone, a second protective structure on the dorsal side arranged to protect at least a portion of a thumb metacarpal bone, and a third protective structure arranged between the first protective structure and the second protective structure. The second protective structure is separate from the first protective structure, and the third protective structure is separate from the first and second protective structures. The third protective structure includes at least three protrusions spaced apart from each other.

14 Claims, 8 Drawing Sheets

(56) References Cited

U.S. PATENT DOCUMENTS

| | | | |
|---|---|---|---|
| 5,560,044 | A | 10/1996 | Masley |
| 5,625,900 | A | 5/1997 | Hayes |
| 5,687,424 | A | 11/1997 | Masley |
| 5,740,551 | A | 4/1998 | Walker |
| 5,815,839 | A | 10/1998 | Safford |
| 5,822,796 | A | 10/1998 | Harges, Jr. et al. |
| 6,029,276 | A | 2/2000 | White |
| 6,098,199 | A | 8/2000 | Barkin |
| 6,389,601 | B2 | 5/2002 | Kleinert |
| 6,415,443 | B1 | 7/2002 | Schierenbeck et al. |
| 6,415,445 | B1 | 7/2002 | Nishijima et al. |
| 6,427,249 | B1 | 8/2002 | Mattesky |
| 6,427,250 | B1 | 8/2002 | Stull et al. |
| 6,536,050 | B1 | 3/2003 | Hill |
| 6,559,453 | B2 | 5/2003 | Lundqvist |
| 6,718,555 | B2 | 4/2004 | Hofmann |
| 6,732,378 | B2 | 5/2004 | Novak |
| 6,836,905 | B2 | 1/2005 | Sande |
| 7,000,256 | B2 | 2/2006 | Kleinert |
| 7,000,257 | B2 | 2/2006 | Bevier |
| 7,000,259 | B2 | 2/2006 | Matechen |
| 7,370,373 | B2 | 5/2008 | Kohler |
| 7,478,440 | B2 | 1/2009 | Dolenak |
| D608,978 | S | 2/2010 | Votel |
| D609,861 | S | 2/2010 | Fitzgerald |
| D619,305 | S | 7/2010 | Fitzgerald |
| D621,552 | S | 8/2010 | Fitzgerald |
| D621,553 | S | 8/2010 | Fitzgerald |
| 7,774,860 | B2 | 8/2010 | Kohler |
| D625,051 | S | 10/2010 | Fitzgerald |
| D648,490 | S | 11/2011 | Choi et al. |
| D650,532 | S | 12/2011 | Choi |
| 8,137,606 | B2 | 3/2012 | Thompson et al. |
| 8,528,117 | B2 | 9/2013 | Asiaghi |
| D695,968 | S | 12/2013 | Ruminski |
| D695,969 | S | 12/2013 | Ruminski |
| D701,349 | S | 3/2014 | Miller et al. |
| D703,389 | S | 4/2014 | Ruminski |
| D717,498 | S | 11/2014 | Leach |
| 8,935,812 | B2 | 1/2015 | Safford |
| D721,868 | S | 2/2015 | Fisher |
| D722,208 | S | 2/2015 | Votel et al. |
| 8,950,015 | B2 | 2/2015 | Gibby |
| D733,364 | S | 6/2015 | Choi et al. |
| D745,746 | S | 12/2015 | Hughes et al. |
| 9,198,474 | B1 | 12/2015 | Nacobian |
| D748,343 | S | 1/2016 | Wyatt et al. |
| 9,241,519 | B2 | 1/2016 | Jaeger |
| D750,845 | S | 3/2016 | Kawano |
| 9,298,326 | B2 | 3/2016 | Spenser |
| D756,039 | S | 5/2016 | Jaeger |
| 9,346,202 | B2 | 5/2016 | Gellis |
| D759,318 | S | 6/2016 | Wyatt et al. |
| D776,364 | S | 1/2017 | Kawano et al. |
| D788,402 | S | 6/2017 | Votel et al. |
| D796,779 | S | 9/2017 | Votel et al. |
| D809,714 | S | 2/2018 | Lim |
| D818,666 | S | 5/2018 | Urbelis |
| D824,111 | S | 7/2018 | Lim |
| D824,599 | S | 7/2018 | Lim |
| D824,640 | S | 8/2018 | Votel et al. |
| 2005/0183184 | A1 | 8/2005 | Hatch et al. |
| 2005/0251893 | A1 | 11/2005 | Hayden et al. |
| 2006/0048259 | A1 | 3/2006 | Keppler et al. |
| 2006/0048268 | A1 | 3/2006 | Loos |
| 2006/0212990 | A1 | 9/2006 | Mattersky |
| 2007/0136928 | A1 | 6/2007 | Dolenak |
| 2007/0220655 | A1 | 9/2007 | Aoki |
| 2007/0245453 | A1 | 10/2007 | Dolenak |
| 2008/0109933 | A1 | 5/2008 | Dolenak |
| 2008/0109935 | A1 | 5/2008 | DeBlasis |
| 2008/0263747 | A1 | 10/2008 | DeBlasis et al. |
| 2009/0019613 | A1 | 1/2009 | Carcaterra et al. |
| 2009/0038052 | A1 | 2/2009 | Gellis |
| 2009/0288236 | A1 | 11/2009 | Hawkes |
| 2010/0071114 | A1 | 3/2010 | Jaeger |
| 2010/0090966 | A1 | 4/2010 | Gregorio |
| 2010/0186457 | A1 | 7/2010 | Zhu |
| 2010/0275342 | A1 | 11/2010 | Sweeney et al. |
| 2011/0047672 | A1 | 3/2011 | Hatfield |
| 2011/0067165 | A1* | 3/2011 | Fream ..... A63B 71/143 2/161.1 |
| 2011/0068028 | A1 | 3/2011 | Harriman et al. |
| 2011/0277215 | A1 | 11/2011 | Lee et al. |
| 2012/0054937 | A1 | 3/2012 | Robaire et al. |
| 2012/0128995 | A1 | 5/2012 | Leto et al. |
| 2012/0159681 | A1 | 6/2012 | Gibby |
| 2012/0204321 | A1 | 8/2012 | Connelly et al. |
| 2012/0227157 | A1* | 9/2012 | Kleinert ..... A41D 13/081 2/161.1 |
| 2012/0227158 | A1 | 9/2012 | Ashworth et al. |
| 2012/0240308 | A1 | 9/2012 | Thompson |
| 2013/0074242 | A1 | 3/2013 | Moreland et al. |
| 2013/0104285 | A1 | 5/2013 | Nolan |
| 2013/0180027 | A1 | 7/2013 | Rock |
| 2013/0305430 | A1 | 11/2013 | Tomono |
| 2014/0026282 | A1 | 1/2014 | Rusakov et al. |
| 2014/0033392 | A1 | 2/2014 | Bulan et al. |
| 2014/0059739 | A1 | 3/2014 | Gellis |
| 2014/0099431 | A1 | 4/2014 | O'Leary |
| 2014/0143926 | A1* | 5/2014 | Brown ..... A63B 71/143 2/20 |
| 2014/0157832 | A1 | 6/2014 | Thompson et al. |
| 2014/0215685 | A1* | 8/2014 | Bush ..... A41D 19/01523 2/161.1 |
| 2015/0047088 | A1 | 2/2015 | Contant et al. |
| 2015/0119200 | A1 | 4/2015 | Jones |
| 2015/0128324 | A1 | 5/2015 | Baker et al. |
| 2015/0185872 | A1 | 7/2015 | Leto |
| 2015/0220146 | A1 | 8/2015 | Fisher et al. |
| 2016/0135520 | A1 | 5/2016 | Jung |
| 2016/0235140 | A1 | 8/2016 | Hoppe |
| 2017/0265540 | A1 | 9/2017 | Kolmes |

FOREIGN PATENT DOCUMENTS

| | | |
|---|---|---|
| CN | 202680583 | 1/2013 |
| CN | 202821761 U | 3/2013 |
| CN | 203152571 | 8/2013 |
| CN | 203563727 | 4/2014 |
| CN | 203618841 | 6/2014 |
| CN | 203662075 | 6/2014 |
| CN | 205018357 | 2/2016 |
| JP | 3086188 | 6/2002 |
| WO | 2010151727 | 12/2010 |

* cited by examiner

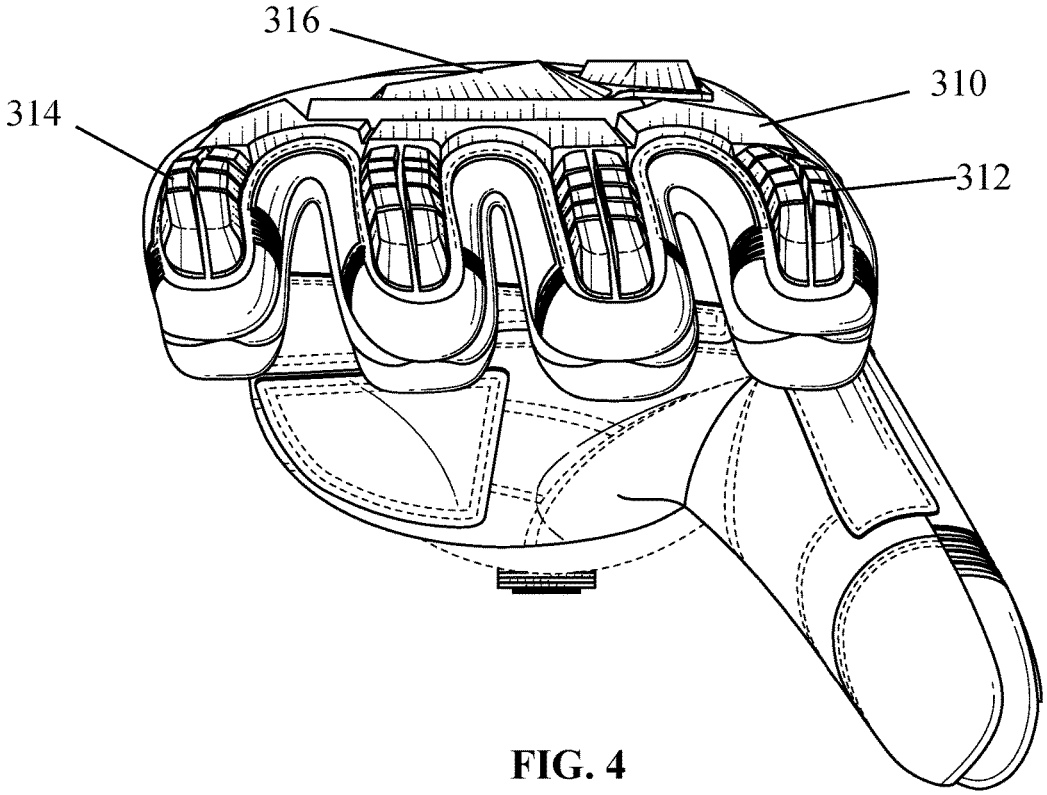
FIG. 4
FIG. 5
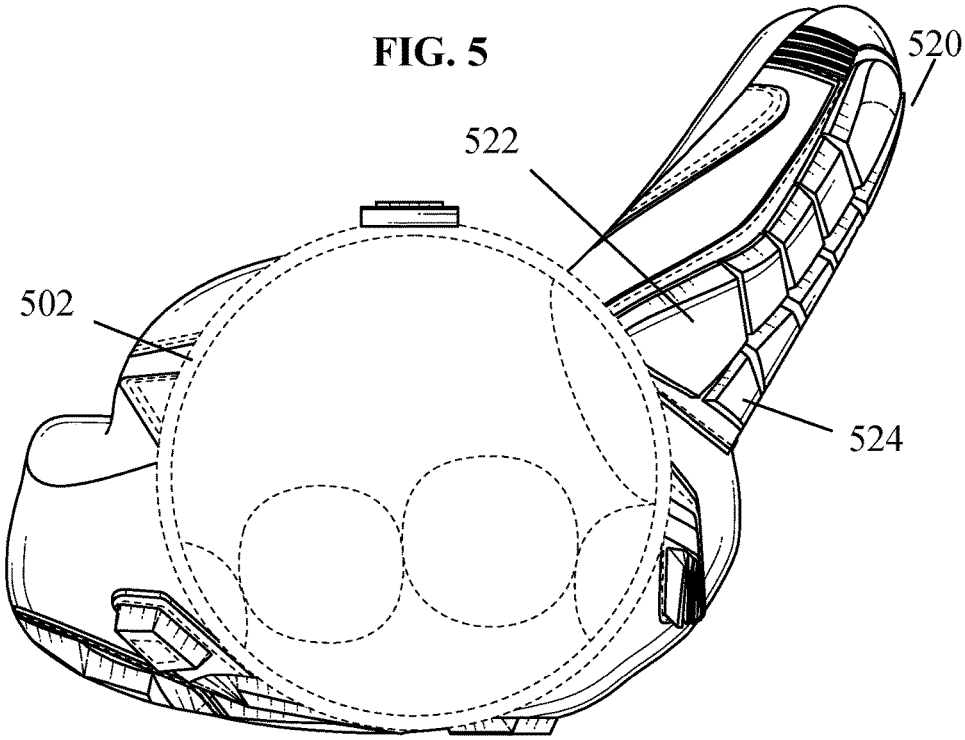

PROTECTIVE GLOVE INCLUDING IMPACT PROTECTION

BACKGROUND

Technical Field

The present disclosure relates to protective gloves and, more particularly, to gloves that provide impact protection.

Background of Related Art

Protective gloves are commonly used to guard the wearer from hazardous chemicals, fluids, impact trauma, wounds, abrasions, and the like. In addition to providing these protections, glove manufacturers strive to provide protective gloves that are comfortable, durable, and do not inhibit the wearer's natural dexterity.

Certain industries require gloves having specific levels of protection suitable for use in the environments typical in that particular industry. To this end, standard rating systems have been implemented to enable a user to readily identify whether a particular safety glove is suitable for use in the intended industry. One such system is the European Norm (EN), which designates whether a particular article is compliant with essential requirements. EN 388, for example, designates whether a glove provides adequate protection from mechanical risks. EN 374-1, as another example, designates whether a glove provides chemical resistance (and to what chemicals the glove is sufficiently resistant) and micro-organism resistance. EN 420, as still another example, designates whether a glove meets the general requirements for protective gloves in terms of construction, fitness, safety, etc.

In addition to rating systems such as the EN, markings such as the European Conformity (CE Marking) are utilized by glove manufacturers to indicate that a particular article complies with the relevant directives for that particular class of articles. With respect to safety gloves, for example, the Personal Protection Equipment (PPE) Directive 89/686/EEC is the relevant directive for achieving CE Marking status.

SUMMARY

To the extent consistent, any of the aspects and features detailed herein may be used in conjunction with any or all of the other aspects and features detailed herein.

Provided in accordance with aspects of the present disclosure is a glove including one or more fabric coupled together into a form of a hand, with the form having a palm side and a dorsal side opposite the palm side. The glove has protective structures on the dorsal side.

In aspects of the present disclosure, the protective structures include a first protective structure on the dorsal side arranged to protect all or a portion of an index finger metacarpal bone and a second protective structure on the dorsal side arranged to protect all or a portion of a thumb metacarpal bone, with the second protective structure being separate from the first protective structure. The protective structures include a third protective structure that is arranged between the first protective structure and the second protective structure. The third protective structure is separate from the first protective structure and the second protective structure and includes three or more protrusions spaced apart from each other.

In aspects of the present disclosure, one of the protective structures has a first height and another of the protective structures has a second height different from the first height.

In aspects of the present disclosure, the third protective structure further includes a base layer, and the three or more protrusions are secured to the base layer. In aspects of the present disclosure, the perimeter of the base layer has a quadrangle shape.

In aspects of the present disclosure, the thumb metacarpal bone and the index finger metacarpal bone define radial directions. In the third protective structure, a first protrusion of the three or more protrusions is positioned adjacent to the thumb metacarpal bone and extends in a radial direction. The remaining protrusions are positioned adjacent to the index finger metacarpal bone and are arranged in a row in the radial direction.

In aspects of the present disclosure, the first protrusion is an elongated protrusion arranged to protect at least a portion of a trapezium bone, and another protrusion is arranged to protect at least a portion of a trapezoid bone. In one embodiment, the elongated protrusion includes two ends with one end being wider than the other end. In one embodiment, one of the protrusions has a triangular shape and another protrusion has a parallelogram shape.

In aspects of the present disclosure, the first protective structure includes two or more protrusions spaced apart from each other and secured to a common base layer, where one of the two protrusions is configured to protect all or a portion of the index finger distal phalange bone. In one embodiment, one of the protrusions has a parallelogram shape and another has a trapezoid shape.

In aspects of the present disclosure, the first protective structure is configured to further protect all or a portion of the little finger metacarpal bone.

In aspects of the present disclosure, the second protective structure is configured to further protect at least a portion of a hand scaphoid, trapezoid, and trapezium bones and includes five or more protrusions that are spaced apart from each other and that are arranged in two rows.

In aspects of the present disclosure, the protective glove further includes a sleeve attached to the fabric that is in the form of the hand, and further includes a fourth protective structure on the palm side of the sleeve.

In aspects of the present disclosure, the one or more fabric coupled together into the form of the hand covers only a portion of a finger and does not cover the entire finger.

BRIEF DESCRIPTION OF THE DRAWINGS

Various aspects and features of the present disclosure are described herein with reference to the drawings wherein like reference numerals identify similar or identical elements and:

FIG. 4 is a first end view of a protective glove provided in accordance with aspects of the present disclosure;

FIG. 5 is a second end view of a protective glove provided in accordance with aspects of the present disclosure;

DETAILED DESCRIPTION

Figure 1:
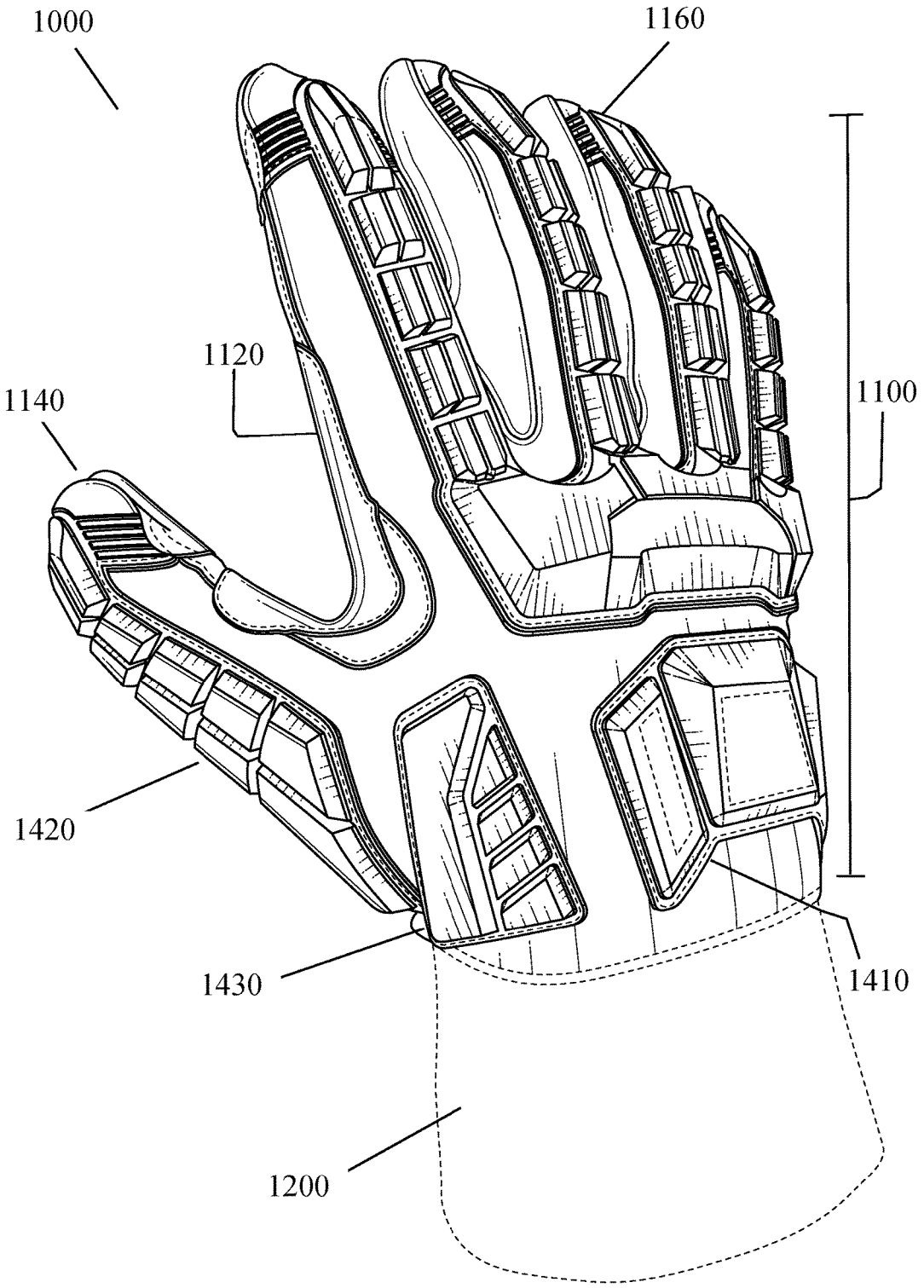
FIG. 1 is a perspective view of a protective glove provided in accordance with aspects of the present disclosure.

Referring to FIG. 1, a protective glove provided in accordance with the present disclosure is shown generally identified by reference numeral 1000. Protective glove 1000 includes a hand-receiving portion 1100 and an elongated wrist portion 1200 extending from hand-receiving portion 1100. Hand-receiving portion 1100 is shaped to generally conform to a human hand and includes a dorsal side (as illustrated), a palm side 1120, a thumb pocket 1140, and four (4) finger pockets 1160. The illustrated thumb pocket 1140 and finger pockets 1160 cover the digits entirely, but embodiments of the disclosed glove can cover only a portion of the thumb and fingers. Elongated wrist portion 1200 is integrally formed with hand-receiving portion 1100 and has a length suitable for covering at least a portion of the wearer's lower arm. It is envisioned that various sizes of protective glove 1000 may be provided, such as small (measuring about 35 cm from the tip end of the middle finger pocket to the open end of elongated wrist portion 1200), medium (measuring about 40 cm), and large (measuring about 50 cm), to ensure adequate fit for a wide range of users.

Protective glove 1000 can be formed from one fabric or multiple fabrics couple together into the shape of a hand. As used herein, "fabric" refers to any sheet of material composed of natural and/or synthetic fibers. The glove can include an inner layer that contacts a wearer's hand and wrist. The inner layer can be knit to form a single construction and can be made from one or a combination of aramid fibers, cotton fibers, and glass fibers. The inner layer provides cut resistance, comfort, and sweat absorption, and may extend the entire length of the glove 1000. With respect to the exterior of protective glove 1000, an exterior layer can be knitted from fabric components such as Polyester, Spandex, Lycra, and Kevlar or any synthetic fiber that is known to have exceptional elasticity. For example, in one embodiment, the exterior layer may comprise about 86% Polyester and 14% Spandex. The inner layer and the outer layer can be formed using hand sewing methods or automated sewing techniques, which can apply traditional stitching thread or yarn or thermo poly rubber ("TPR") stitching thread made of about 90% Nylon. It is envisioned that other stitching threads such as, but not limited to, cotton, polyester, linen, rayon, and the like could be used. In various embodiments, the glove may have a single layer of fabric or may have more than two layers of fabric. Each layer may be composed of one or more different fabrics.

As shown in FIG. 1, the illustrated glove includes protective structures on the dorsal side of the glove. The glove includes a first protective structure 1410 on the dorsal side of the glove that protects at least part of the index finger metacarpal bone. The first protective structure 1410 can protect other portions of the hand, and in the illustrated embodiment, the first protective structure 1410 also protects at least part of the other metacarpal bones. As illustrated, the first protective structure includes a base layer and a number of protrusions that are spaced apart on the common base layer. Other arrangements and configurations are contemplated to be within the scope of the present disclosure.

The glove of FIG. 1 includes a second protective structure 1420 on the dorsal side of the glove that protects at least part of the pollex, i.e., thumb metacarpal bone. As illustrated, the second protective structure 1420 is separate and distinct from the first protective structure 1410, and includes a number of protrusions on a common base layer.

In accordance with aspects of the present disclosure, the glove of FIG. 1 includes a third protective structure 1430 arranged between the first protective structure 1410 and the second protective 1420 structure. The third protective structure 1430 is separate and distinct from the first protective structure 1410 and the second protective structure 1420, and also includes a number of protrusions on a common base layer.

Generally, the first, second, and third protective structures 1410, 1420, and 1430, and other illustrated protective structures, and the protrusions therein are arranged to protect portions of the hand without unduly hampering hand motion and dexterity. For example, protrusions can be spaced apart so that spaces between protrusions are arranged over joints or over areas that bend, flex, articulate, or otherwise move. The protrusions can have various shapes, heights, and arrangements. For example, the perimeters of the protrusions can substantially be in the shape of triangles, rectangles, parallelograms, trapezoids, and other geometric shapes. Particular shapes may be appropriate based on the motion of different portions of the hand. The protrusions can extend away from the glove fabric in different heights. For example, one protrusion may be higher than another protrusion, or one protective structure may be higher than another protective structure. The protective structures 1410, 1420, and 1430 will now be discussed in more detail below.

Figure 2:
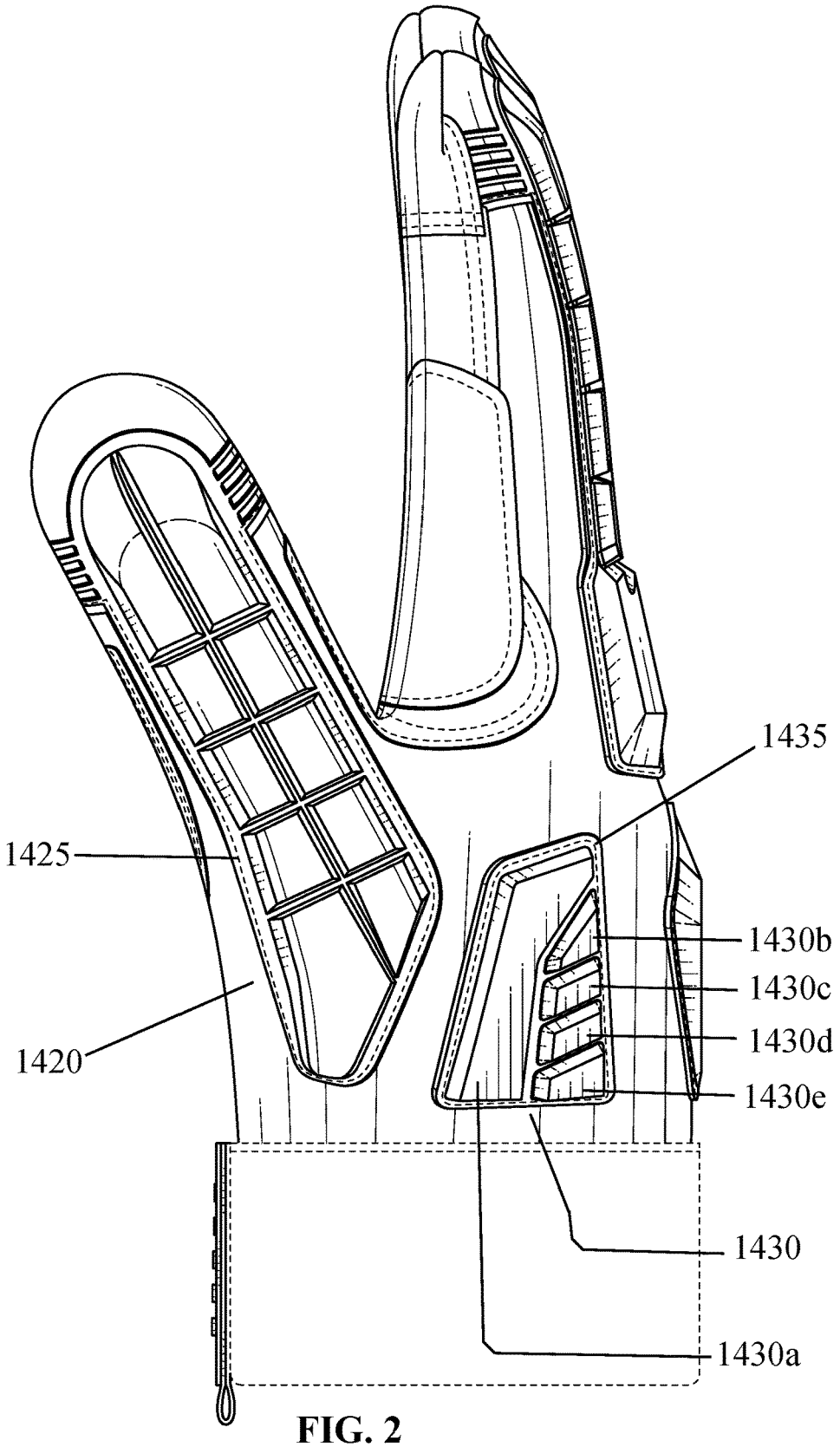
FIG. 2 is a side view of the protective glove of FIG. 1.

FIG. 2 is a side view of the glove of FIG. 1 and shows the second and third protective structures more clearly from a more direct angle. The second protective structure 1420 is disposed over the thumb and provides several protrusions that are spaced apart to permit greater range of motion and movement of the thumb. The protrusions of the second protective structure 1420 all share a common base layer 1425. The second protective structure 1420 protects at least a part of the thumb metacarpal bone. In the illustrated embodiment, the second protective structure 1420 also protects the thumb phalanges.

The third protective structure 1430 is located adjacent to and is separate from the second protective structure 1420. Generally, the third protective structure 1430 is located between other structures that protect the index finger metacarpal bone and the thumb metacarpal bone, but the third protective structure 1430 can also function to protect those bones from certain impact angles. The third protective structure includes three or more protrusions, and as illustrated in FIG. 2, the third protective structure 1430 includes five protrusions **1430*a*-1430*e* on a common base layer 1435**.

Generally, the thumb and finger metacarpal bones define five radial directions that extend from the wrist and align with those metacarpal bones. An infinite number of other radial directions are located between the five radial directions aligned with the metacarpal bones and also extend from the wrist. With continuing reference to FIG. 2, the third protective structure 1430 includes a first protrusion **1430*a* that is positioned adjacent to the thumb metacarpal bone and extends substantially in a radial direction, which in FIG. 2 can be the radial direction defined by the index finger metacarpal bone. The other protrusions 1430*b*-1430*d* are positioned adjacent to the index finger metacarpal bone and are arranged in a row in the radial direction of the index finger metacarpal bone. The protrusions can be arranged to protect at least a portion of trapezoid and/or trapezium bones. The illustrated first protrusion 1430*a*** is an elongated protrusion that has one end that is wider than the other end.

The other protrusions 1430*b*-1430*d* have various shapes. For example, as shown in FIG. 2, protrusion 1430*b* has a triangular shape, protrusions 1430*c* and 1430*d* have a parallelogram shape, and protrusion 1430*e* has a trapezoidal shape. The protrusions in the third protective structure 1430 of FIG. 2 are configured and arranged to protect the area between the thumb and index finger metacarpal bones while permitting motion in that portion of the hand when the hand opens or grips and object or when the fingers pinch together. The protrusions 1430*a*-1430*e* share a common base layer 1435. In one embodiment, the protrusions 1430*a*-1430*e* can have the same height. In various embodiments, the protrusions 1430*a*-1430*e* can have different heights.

Figure 3:
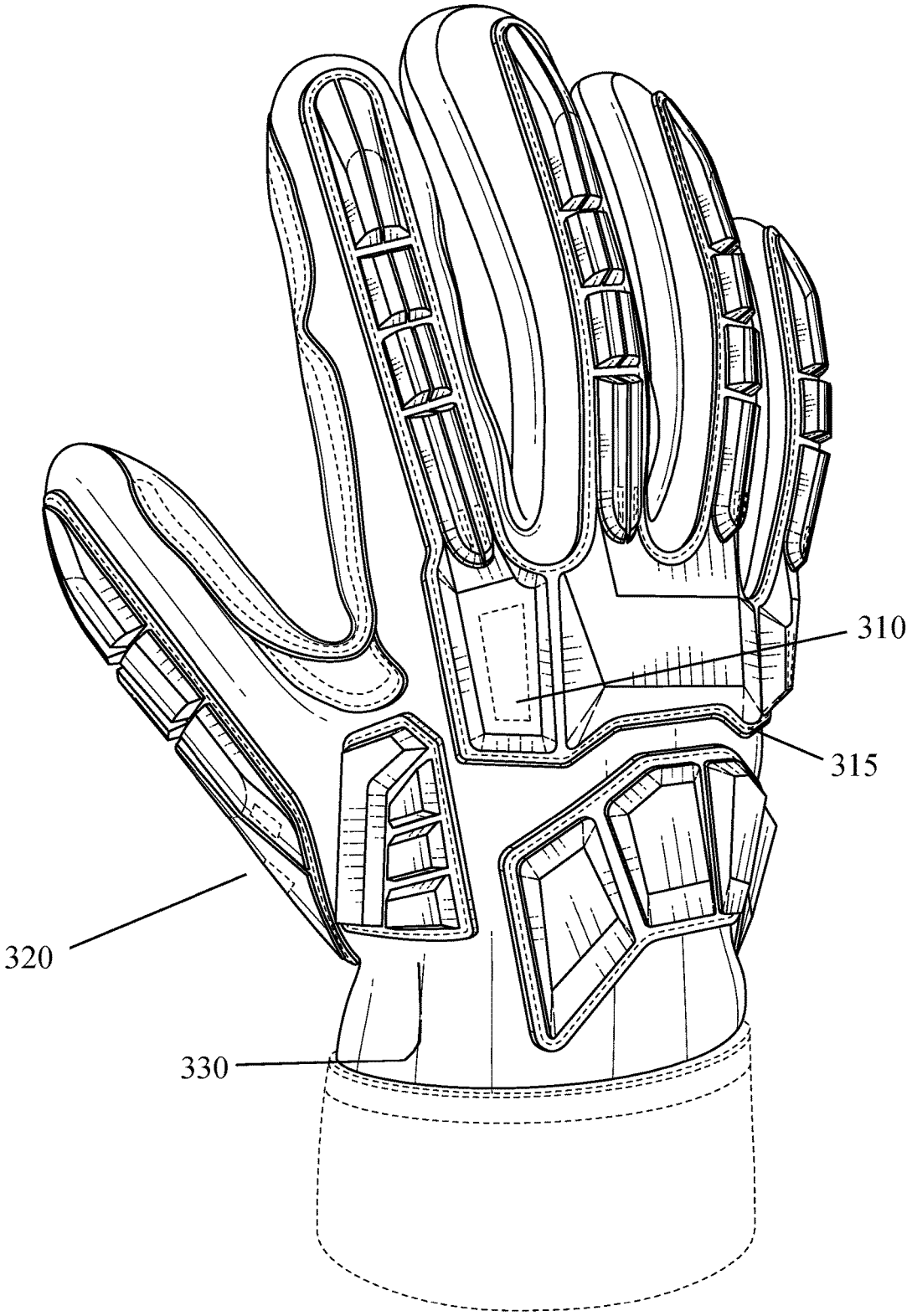
FIG. 3 is a perspective view of another protective glove provided in accordance with aspects of the present disclosure.

Referring to FIG. 3, there is shown another embodiment of a glove having first, second, and third protective structures 310, 320, and 330. The protective structures of FIG. 3 differ from the protective structures of FIG. 2 in the shape, size, and arrangement of protrusions. In FIG. 3, the first protective structure 310 is a different protective structure altogether from the first protective structure 1410 of FIG. 1. However, in accordance with aspects of the present disclosure, the first protective structure 310 still protects part of the index finger metacarpal bone. The first protective structure 310 includes a common base layer 315 and a larger number of protrusions on the common base layer 315. Those protrusions together with the common base layer 315 are collectively referred to as the first protective structure 310. As shown in FIG. 3, the first protective structure 310 protects the phalanges of all of the fingers.

The second protective structure 320 includes a fewer number of protrusions than the second protective structure 1420 of FIGS. 1 and 2, but still protects part of the thumb metacarpal bone. The third protective structure 330 includes four protrusions in the same general arrangement as FIGS. 1 and 2, and is still located between the first and second protective structures. The third protective structure 330 of FIG. 3 is smaller than the third protective structure 1430 of FIGS. 1 and 2 and may be more suitable when there is lesser risk of impact to that portion of the hand. FIG. 3 is merely illustrative and other arrangements and configurations of the protective structures are contemplated.

Referring also to FIG. 4, there is shown a first-end view of the glove of FIG. 3. With respect to the first protective structure 310, it may be desirable for the protrusions protecting at least one of the finger phalanges to have a curved arrangement 312, 314. The curved arrangement may increase finger dexterity and hand movement in particular applications or industries. Additionally, as shown in FIG. 4, various protrusions may have a sloped apex or ridge or plateau 316 that is shaped and configured to address particular impact risks of particular applications or industries.

Referring to FIG. 5, there is shown a second-end view of a glove in accordance with aspects of the disclosed technology. The glove includes one or more fabrics 502 coupled together into the form of a hand and includes an opening for receiving a hand. The fabrics 502 can form one layer of fabric or multiple layers of fabric. Each layer can be composed of one or more fabrics. The protective structures, such as the second protective structure 520, are secured to the outside of the fabric 502 using techniques that will be recognized by those skilled in the art, including threading and stitching, sonic welding, among others. Fabric 502 provides sufficient structural support so as to serve as a substrate upon which protective structures are secured. The protective structures, such as the second protective structure 520 and protrusions 522, 524, are formed from thermo poly rubber ("TPR") and may have a thickness of, for example, about 6 mm on areas above knuckles, fingers, and thumb, and about 2-5 mm above the metacarpal bones. The protective structures, such as the second protective structure 520 and protrusions 522, 524, may further have a hardness of about 30-40 Shore A. Other materials, construction, heights, and durability, among other characteristics, are contemplated to be encompassed with the scope of the present disclosure.

In accordance with one aspect of the present disclosure, protrusions 522, 524 can be configured and arranged to protect at least part of the scaphoid, trapezoid, and/or trapezium bones.

Figure 6:
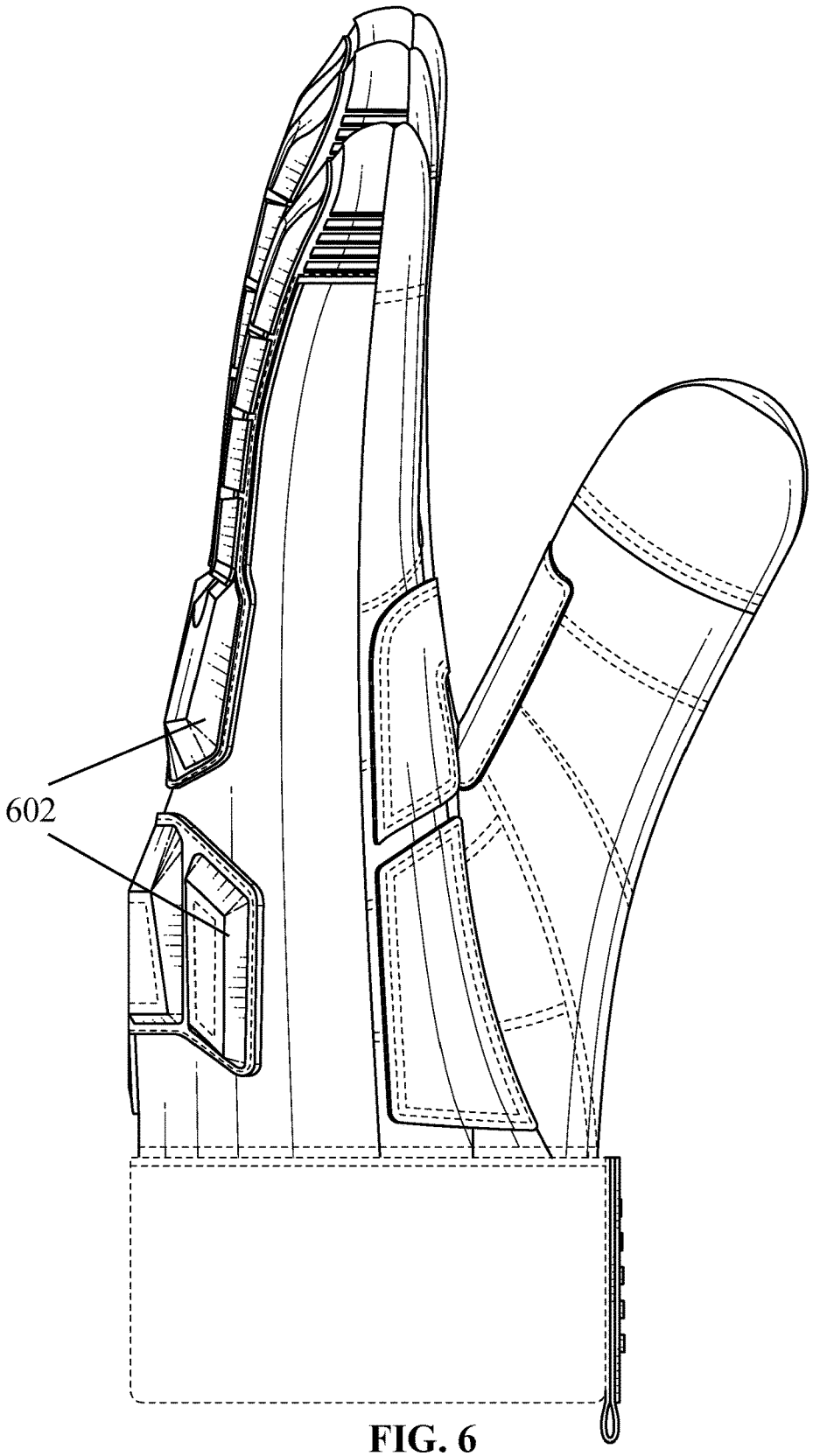
FIG. 6 is a side view of a protective glove provided in accordance with aspects of the present disclosure.

FIG. 6 shows a side view of a glove according to the present disclosure. As shown in FIG. 6, the first protective structure 602 can be either one of the two illustrated structures and can extend to and protect the digitus minimus manus, or commonly referred to simply as the "little finger," and the little finger metacarpal bone, or beyond.

Figure 7:
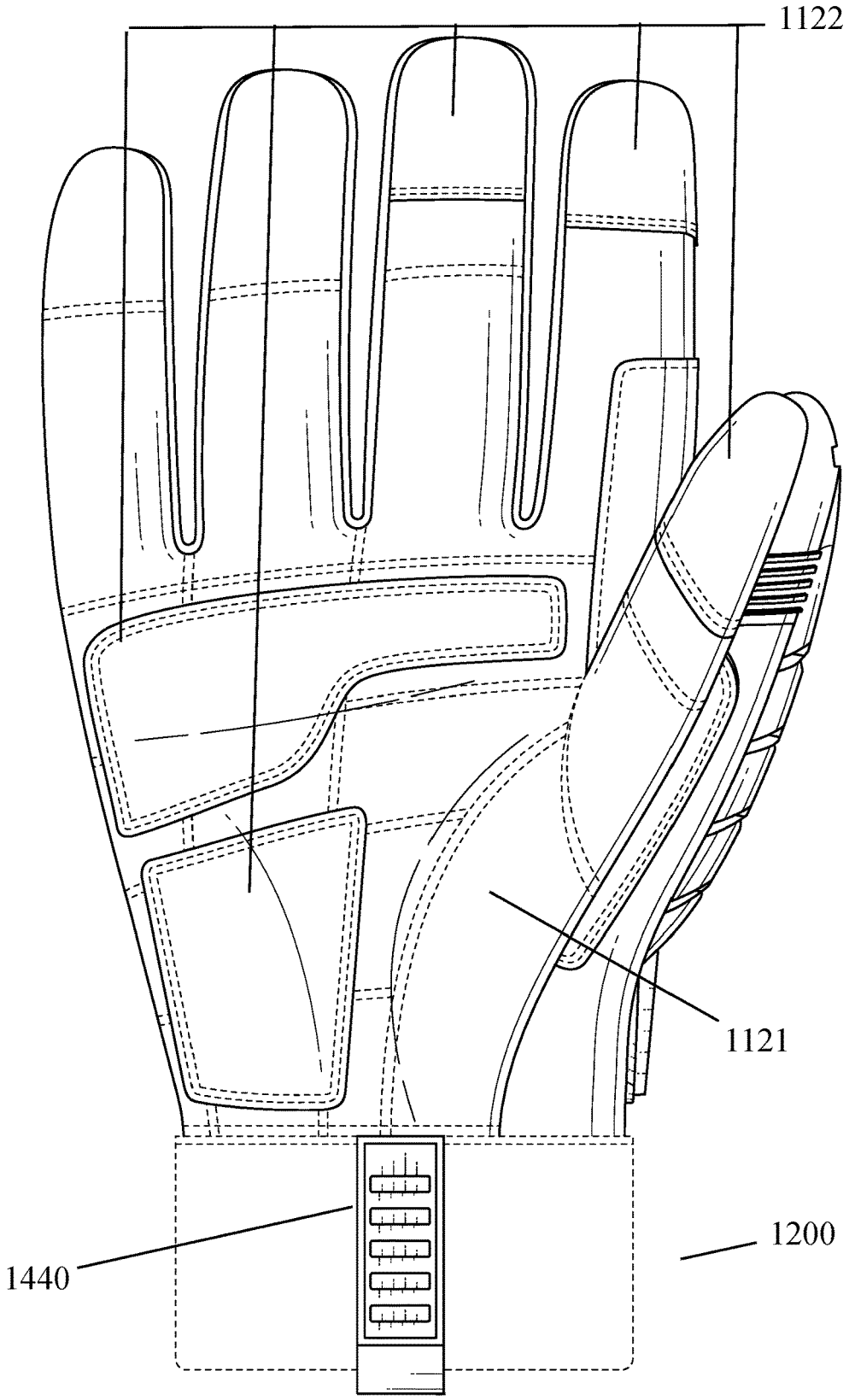
FIG. 7 is a bottom view of a protective glove provided in accordance with aspects of the present disclosure.
Figure 8:
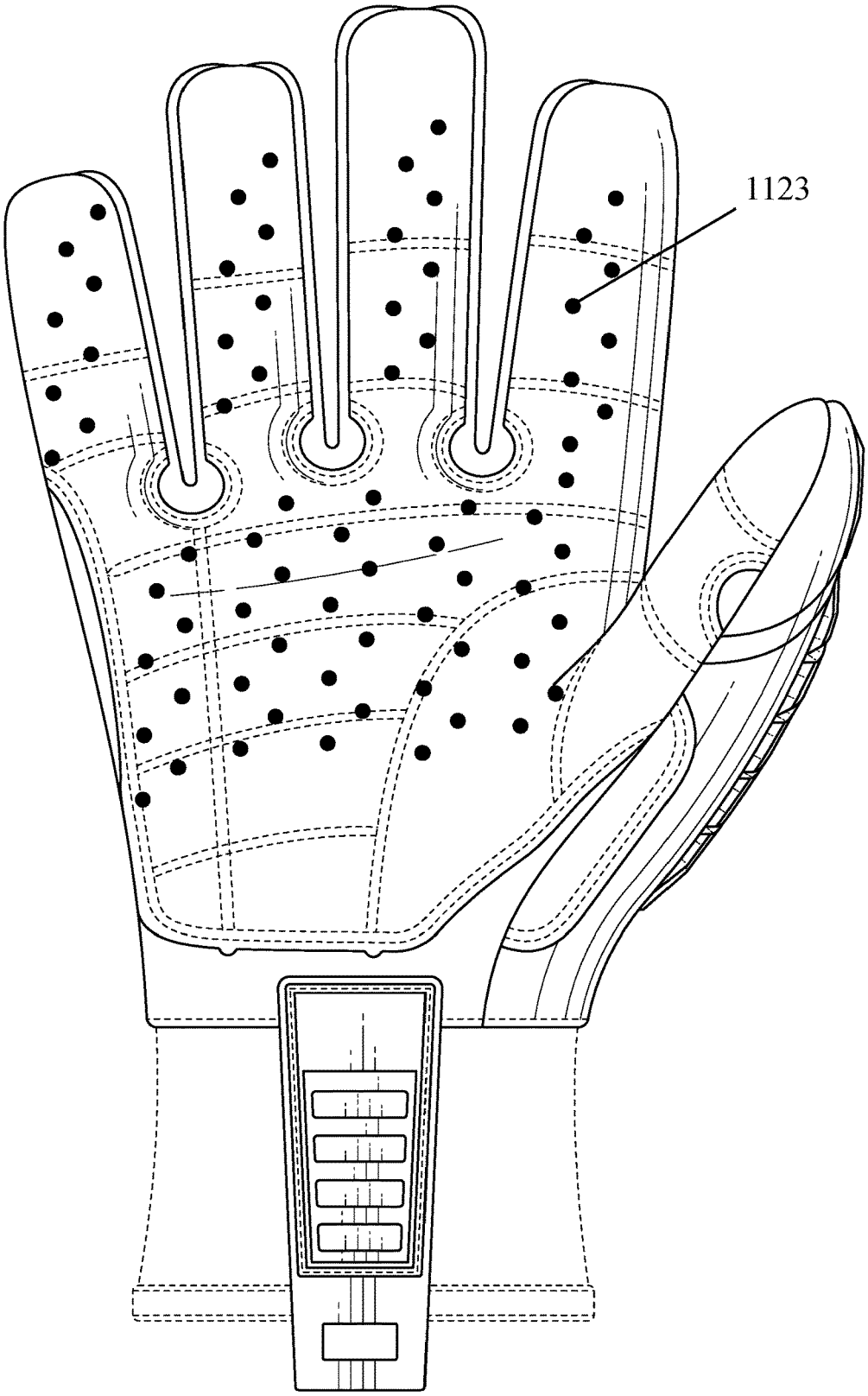
FIG. 8 is a bottom view of another protective glove provided in accordance with aspects of the present disclosure.
Figure 9:
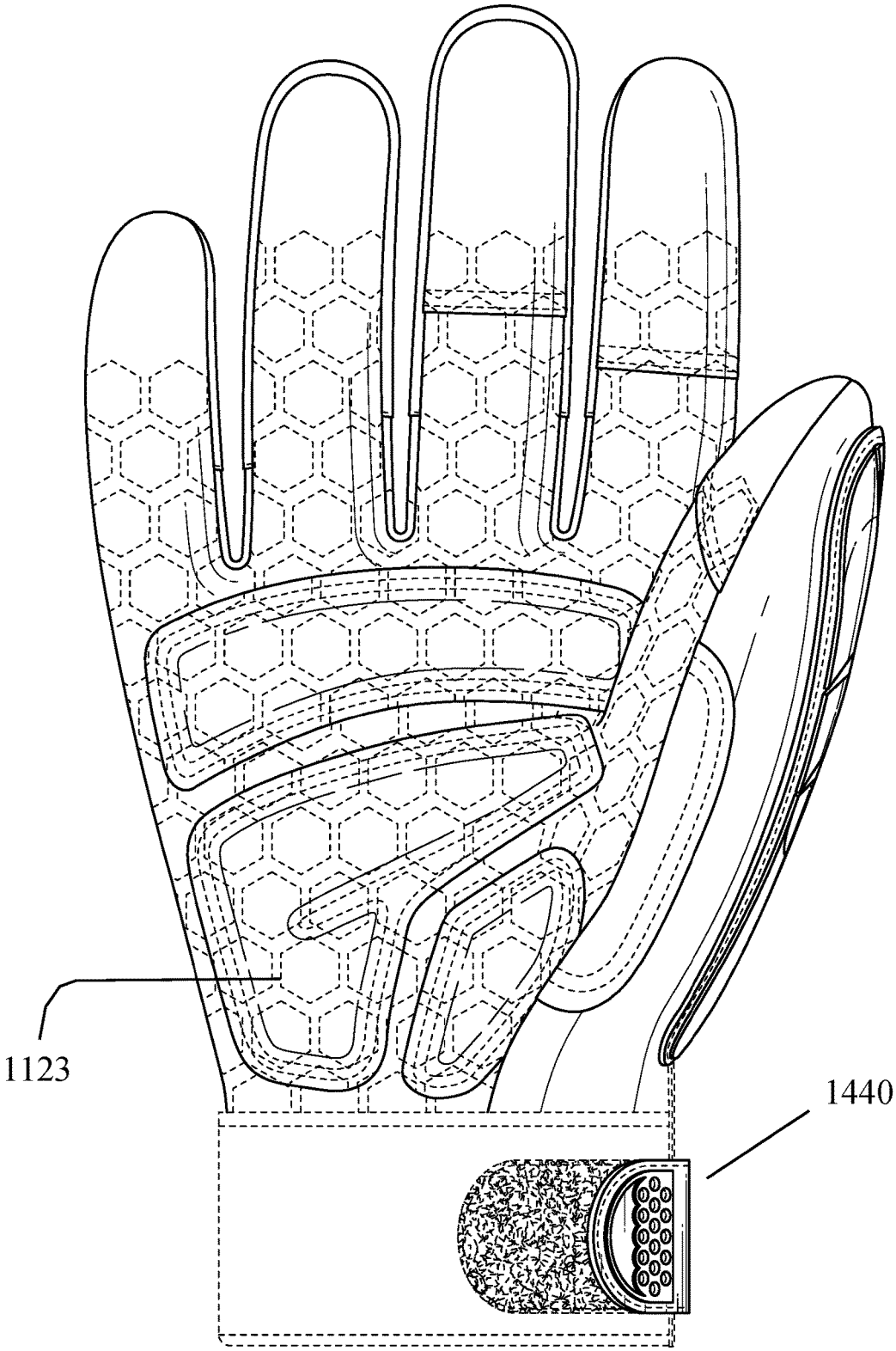
FIG. 9 is a bottom view of yet another protective glove provided in accordance with aspects of the present disclosure.

Turning to FIGS. 7-9, various embodiments of the palm side of a glove in accordance with the present disclosure are shown. Palm side may include a plurality of protective padding/structures 1121, 1122 which are suitably cut-resistant, abrasion-resistant, and/or tear-resistant. The padding 1121, 1122 may be disposed in areas accordingly to particular industry requirements. For example, as shown in FIG. 7, padding may include a panel 1121 which can be secured to the fabric of the palm side of the glove. To further increase protection of a wearer's palm, a set of padding 1122 are disposed in areas where extra protection or greater durability or comfort are needed. The glove fabric at the palm may be formed of components such as PVC, Nylon, leather, Polyester, Spandex, and other suitable components that may enhance protection of the palm. For example, with respect to percentage by weight, fabric of the palm may be composed of 45% to 65% PVC, 25% to 35 PU, and 15% to 25% Nylon. Other compositions and materials are contemplated.

FIG. 8 shows another embodiment of a palm having a plurality of gripping structures 1123 which can provide enhanced grip. FIG. 9 shows yet another embodiment with gripping structures 1123 having a different configuration and arrangement.

With respect to FIGS. 7 and 8, elongated wrist portion 1200 may be a substantially cylindrical form and may be composed of the same materials used for other portions of the glove. For example, with respect to percentage by weight, the elongated wrist portion 1200 may be composed of 80% to 90% nylon and 10% to 20% PU. To enhance protection of the wearer's wrist, elongated wrist portion 1200 may include a fourth protective structure 1440. The fourth protective structure 1440 can be composed of materials similar to those describe above herein.

As shown in FIG. 7, the fourth protective structure 1440 includes protrusions that are spaced apart. FIGS. 8 and 9 show other embodiments of protective structure 1440.

From the foregoing and with reference to the various drawing figures, those skilled in the art will appreciate that certain modifications can be made to the present disclosure without departing from the scope of the same. While exemplary embodiments of the disclosure have been shown in the drawings, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

What is claimed is:

1. A glove comprising:

at least one fabric in a shape of a hand and having a palm side and a dorsal side opposite the palm side; and a plurality of protective structures on the dorsal side, the plurality of protective structures including:

a first protective structure on the dorsal side configured and arranged to protect at least a portion of an index finger metacarpal bone;

a second protective structure on the dorsal side configured and arranged to protect at least a portion of a thumb metacarpal bone, the second protective structure being separate from the first protective structure; and a third protective structure arranged between the first protective structure and the second protective structure, the third protective structure being separate from the first protective structure and the second protective structure, and wherein the third protective structure includes at least three protrusions spaced apart from each other.

2. The glove of claim 1, wherein the third protective structure further includes a base layer, the at least three protrusions being secured to the base layer.

3. The glove of claim 1, wherein a first protrusion of the at least three protrusions is configured and arranged to be positioned adjacent to the thumb metacarpal bone and extends substantially in a radial direction, and wherein the remainder of the at least three protrusions are configured and arranged to be positioned adjacent to the index finger metacarpal bone and are arranged in a row substantially in the radial direction.

4. The glove of claim 2, wherein the base layer includes a perimeter having a quadrangle shape.

5. The glove of claim 3, wherein the first protrusion is an elongated protrusion configured and arranged to protect at least a portion of a trapezium bone and another of the at least three protrusions is configured and arranged to protect at least a portion of a trapezoid bone.

6. The glove of claim 3, wherein the elongate protrusion includes two ends with one of the two ends being wider than the other of the two ends.

7. The glove of claim 3, wherein at least one of the at least three protrusions has a triangular shape and another of the at least three protrusions has a parallelogram shape.

8. The glove of claim 1, wherein the first protective structure includes at least two protrusions spaced apart from each other and secured to a common base layer, wherein one of the at least two protrusions is configured to protect at least a portion of an index finger distal phalange bone.

9. The glove of claim 1, wherein the first protective structure is configured to further protect at least a portion of a little finger metacarpal bone.

10. The glove of claim 8, wherein one of the plurality of protective structures has a first height and another of the plurality of protective structures has a second height different from the first height.

11. The glove of claim 8, wherein one of the at least two protrusions has a parallelogram shape and another of the at least two protrusions has a trapezoid shape.

12. The glove of claim 1, further comprising:

a sleeve attached to the at least one fabric in the shape of the hand; and a fourth protective structure on a palm side of the sleeve.

13. The glove of claim 1, wherein the second protective structure is configured to further protect at least a portion of a hand scaphoid, trapezoid, and trapezium bones and includes protrusions arranged in two rows, each row having at least five protrusions spaced apart from each other.

14. The glove of claim 1, wherein the at least one fabric in the shape of the hand is configured and arranged to cover a portion of a finger but not cover an entirety of the finger.

* * * * *